US010091601B2

(12) United States Patent
Boehm

(10) Patent No.: US 10,091,601 B2
(45) Date of Patent: Oct. 2, 2018

(54) METHOD FOR RENDERING MULTI-CHANNEL AUDIO SIGNALS FOR L1 CHANNELS TO A DIFFERENT NUMBER L2 OF LOUDSPEAKER CHANNELS AND APPARATUS FOR RENDERING MULTI-CHANNEL AUDIO SIGNALS FOR L1 CHANNELS TO A DIFFERENT NUMBER L2 OF LOUDSPEAKER CHANNELS

(71) Applicant: Dolby Laboratories Licensing Corporation, San Francisco, CA (US)

(72) Inventor: Johannes Boehm, Goettingen (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/457,718

(22) Filed: Mar. 13, 2017

(65) Prior Publication Data

US 2017/0251322 A1 Aug. 31, 2017

Related U.S. Application Data

(63) Continuation of application No. 14/906,255, filed as application No. PCT/EP2014/065517 on Jul. 18, 2014, now Pat. No. 9,628,933.

(30) Foreign Application Priority Data

Jul. 19, 2013 (EP) ..... 13306042

(51) Int. Cl.
*H04S 3/02* (2006.01)
*H04S 7/00* (2006.01)

(52) U.S. Cl.
CPC ..... *H04S 3/02* (2013.01); *H04S 7/301* (2013.01); *H04S 7/308* (2013.01); *H04S 2400/03* (2013.01)

(58) Field of Classification Search
CPC . H04S 3/02; H04S 7/301; H04S 7/308; H04S 2400/03
See application file for complete search history.

(56) References Cited

U.S. PATENT DOCUMENTS

2006/0098827 A1* 5/2006 Paddock ..... G10L 21/02 381/106
2007/0025559 A1* 2/2007 Mihelich ..... H04S 7/301 381/59

(Continued)

OTHER PUBLICATIONS

Pulkki, Ville "Virtual Sound Source Positioning Using Vector Base Amplitude Panning" J. Audio Engineering Society, vol. 45, pp. 456-466, Jun. 1997.

(Continued)

*Primary Examiner* — Curtis Kuntz
*Assistant Examiner* — Kenny Truong

(57) ABSTRACT

Multi-channel audio content is mixed for a particular loudspeaker setup. However, a consumer's audio setup is very likely to use a different placement of speakers. The present invention provides a method of rendering multi-channel audio that assures replay of the spatial signal components with equal loudness of the signal. A method for obtaining an energy preserving mixing matrix (G) for mixing L1 input audio channels to L2 output channels comprises steps of obtaining a first mixing matrix $\hat{G}$, performing a singular value decomposition on the first mixing matrix $\hat{G}$ to obtain a singularity matrix S, processing the singularity matrix S to obtain a processed singularity matrix $\hat{S}$, determining a scaling factor a, and calculating an improved mixing matrix G according to $G=a\hat{U}\hat{S}V^T$. The perceived sound, loudness, timbre and spatial impression of multi-channel audio replayed on an arbitrary loudspeaker setup practically equals that of the original speaker setup.

7 Claims, 5 Drawing Sheets

(56) References Cited

U.S. PATENT DOCUMENTS

2012/0082319 A1 4/2012 Jot
2017/0034639 A1* 2/2017 Chon ..... G10L 19/008

OTHER PUBLICATIONS

Poletti, Mark "Robust Two-Dimensional Surround Sound Reproduction for Nonuniform Loudspeaker Layouts" J. Audio Eng. Soc., vol. 55, No. 7/8, Jul./Aug. 2007.
Kirkeby, O. et al "Reproduction of Plane Wave Sound Fields" J. Acoust. Soc. Am. 94 (5) Nov. 1993, pp. 2992-3000.
Fazi, F. et al "Surround Sound Panning Technique Based on a Virtual Microphone Array" AES presented at the 128th Convention, May 22-25, 2010, London, UK, pp. 1-12.
Shin, M. et al "Efficient 3D Sound Field Reproduction" AES presented at the 130th Convention, May 13-16, 2011, London, UK, pp. 1-10.
EBU Technical Recommendation R 128 "Loudness Normalisation and Permitted Maximum Level of Audio Signals" Geneva, Aug. 30, 2010.
ITU-R Recommendation ITU-R BS.1770-2 "Algorithms to Measure Audio Programme Loudness and True-Peak Audio Level" Mar. 2011.
ATSC A/85, ATSC Recommended Practice "Techniques for Establishing and Maintaining Audio Loudness for Digital Television" Advanced Television Systems Committee, Washington, D.C. Jul. 25, 2011.
ITU-R BS.775-1, "Multichannel Stereophonic Sound System with and Without Accompanying Picture" 1994, pp. 1-10.
Hamasaki, K. et al "A 22.2 Multichannel Sound System for Ultrahigh-Definition TV (UHDTV)" SMPTE Motion Imaging, pp. 40-49, Apr. 2008.
Fliege, Jorg "A Two-Stage Approach for Computing Cubature Formulae for the Sphere" Technical Report, 1999.
Zotter, F. et al "Energy-Preserving Ambisonic Decoding" ACT Acustica United with Acustica, vol. 98,pp. 37-47, 2012.

* cited by examiner

FIG. 7A
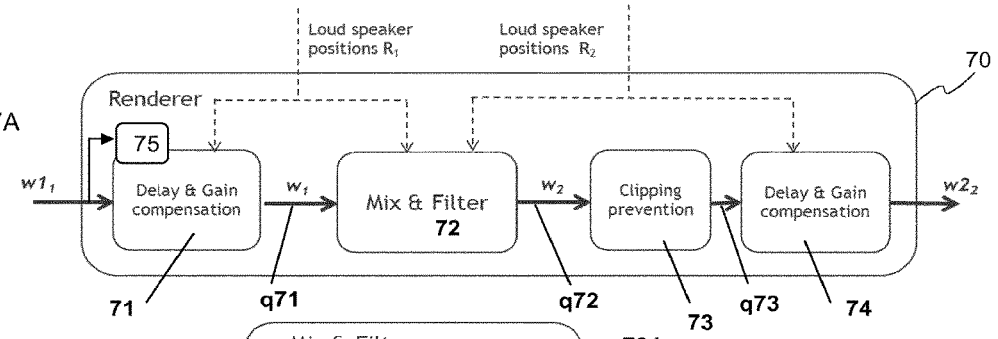
FIG. 7B
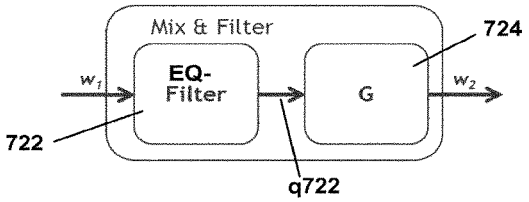
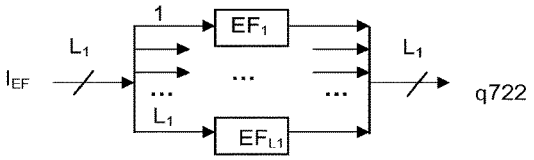
FIG. 8

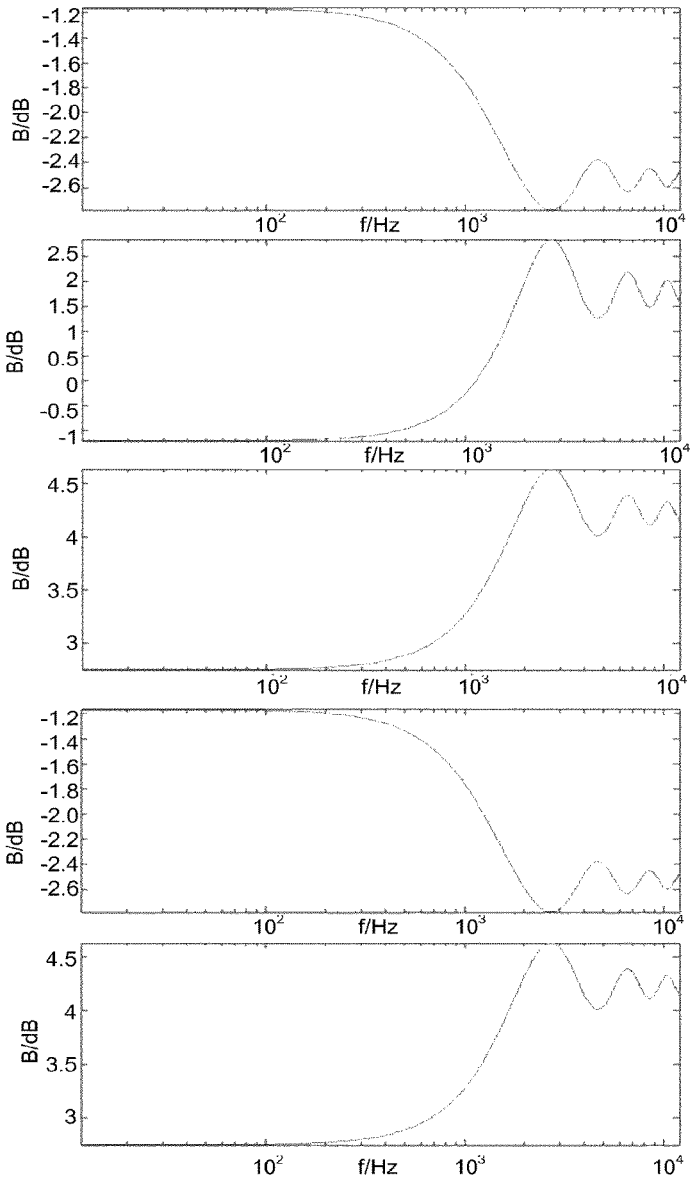
Filter I=1 FIG. 9A
Filter I=2 FIG. 9B
Filter I=3 FIG. 9C
Filter I=4 FIG. 9D
Filter I=5 FIG. 9E
$$G = \begin{bmatrix} 1.33 & -0.18 & 0.57 & 0.60 & 0.12 \\ -0.18 & 1.38 & 0.57 & 0.12 & 0.60 \end{bmatrix}$$

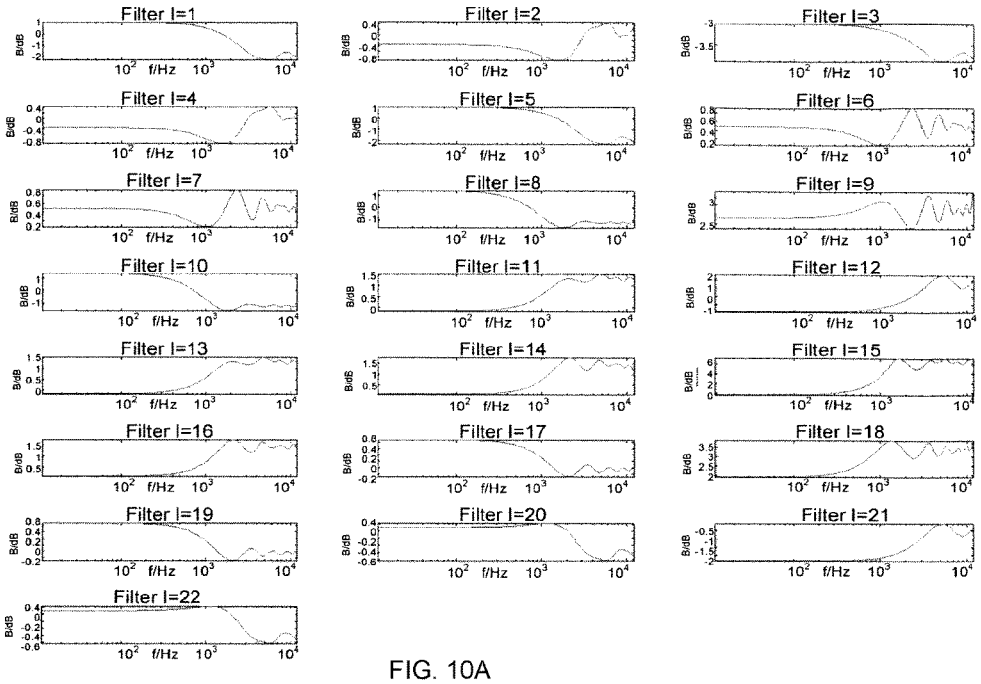
FIG. 10A
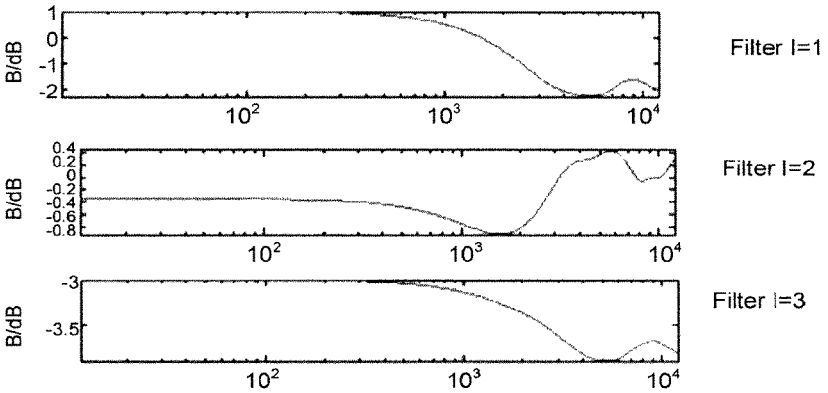
FIG. 10B
$$G = \begin{bmatrix} 1.21 & 0.96 & -0.06 & 0.00 & -0.04 & 0.16 & 0.01 & -0.18 & -0.09 & 0.00 & 0.85 & 0.23 & 0.00 & 0.17 & 0.14 & 0.03 & -0.12 & -0.06 & 0.02 & 1.04 & 0.13 & -0.02 \\ -0.04 & 0.00 & -0.06 & 0.96 & 1.21 & 0.01 & 0.16 & 0.00 & -0.09 & -0.18 & 0.00 & 0.23 & 0.85 & 0.03 & 0.14 & 0.17 & 0.02 & -0.06 & -0.12 & -0.02 & 0.13 & 1.04 \\ -0.31 & 0.17 & 1.54 & 0.17 & -0.31 & 0.02 & 0.02 & -0.04 & -0.07 & -0.04 & 0.05 & 0.76 & 0.05 & 0.07 & 0.20 & 0.07 & -0.00 & -0.03 & -0.00 & -0.12 & 1.05 & -0.12 \\ 0.03 & -0.11 & -0.00 & 0.01 & -0.00 & 0.91 & -0.16 & 1.13 & 0.50 & -0.06 & 0.11 & 0.01 & 0.01 & 0.82 & 0.28 & -0.10 & 1.00 & 0.48 & 0.01 & 0.04 & -0.00 & 0.01 \\ 0.00 & 0.01 & -0.00 & -0.11 & 0.03 & -0.16 & 0.91 & -0.06 & 0.50 & 1.13 & 0.01 & 0.01 & 0.11 & -0.10 & 0.28 & 0.82 & 0.01 & 0.48 & 1.00 & 0.01 & -0.00 & 0.04 \end{bmatrix}$$
FIG. 10C

METHOD FOR RENDERING MULTI-CHANNEL AUDIO SIGNALS FOR L1 CHANNELS TO A DIFFERENT NUMBER L2 OF LOUDSPEAKER CHANNELS AND APPARATUS FOR RENDERING MULTI-CHANNEL AUDIO SIGNALS FOR L1 CHANNELS TO A DIFFERENT NUMBER L2 OF LOUDSPEAKER CHANNELS

FIELD OF THE INVENTION

This invention relates to a method for rendering multi-channel audio signals, and an apparatus for rendering multi-channel audio signals. In particular, the invention relates to a method and apparatus for rendering multi-channel audio signals for L1 channels to a different number L2 of loudspeaker channels.

BACKGROUND

New 3D channel based Audio formats provide audio mixes for loudspeaker channels that not only surround the listening position, but also include channels positioned above (height) and below in respect to the listening position (sweet spot). The mixes are suited for a special positioning of these speakers. Common formats are 22.2 (i.e. 22 channels) or 11.1 (i.e. 11 channels).

FIG. 1 shows two examples of ideal speaker positions in different speaker setups: a 22-channel speaker setup (left) and a 12-channel speaker setup (right). Every node shows the virtual position of a loudspeaker. Real speaker positions that differ in distance to the sweet spot are mapped to the virtual positions by gain and delay compensation.

A renderer for channel based audio receives $L_1$ digital audio signals $w_1$ and processes the output to $L_2$ output signals $w_2$. FIG. 2 shows, in an embodiment, the integration of a renderer 21 into a reproduction chain. The renderer output signal $w_2$ is converted to an analog signal in a D/A converter 22, amplified in an amplifier 23 and reproduced by loudspeakers 24.

The renderer 21 uses the position information of the input speaker setup and the position information of the output loudspeaker 24 setup as input to initialize the chain of processing. This is shown in FIG. 3. Two main processing blocks are a Mixing & Filtering block 31 and a Delay & Gain Compensation block 32.

The speaker position information can be given e.g. in Cartesian or spherical coordinates. The position for the output configuration $R_2$ may be entered manually, or derived via microphone measurements with special test signals, or by any other method. The positions of the input configuration $R_1$ can come with the content by table entry, like an indicator e.g. for 5-channel surround. Ideal standardized loudspeaker positions [9] are assumed. The positions might also be signaled directly using spherical angle positions. A constant radius is assumed for the input configuration.

Let $R_2=[r2_1, r2_2, \ldots, r2_{L_2}]$ with $r2_1=[r2_l, \theta 2_l, \phi 2_l]^T=[r2_l, \hat{\Omega}_l^T]^T$ be the positions of the output configuration in spherical coordinates. Origin of the coordinate system is the sweet spot (i.e. listening position). $r2_l$ is the distance between the listening position and a speaker l, and $\theta_l$, $\phi_l$ are the related spherical angles that indicate the spatial direction of the speaker/relative to the listening position.

Delay and Gain Compensation

The distances are used to derive delays and gains $g_l$ that are applied to the loudspeaker feeds by amplification/attenuation elements and a delay line with $d_l$ unit sample delay steps. First, the maximal distance between a speaker and the sweet spot is determined:

$$r2_{max}=\max([r2_1, \ldots r2_{L_2}]).$$

For each speaker feed the delay is calculated by:

$$d_l=\lfloor (r2_{max}-r2_l)f_s/c+0.5 \rfloor \tag{1}$$

with sampling rate $f_s$, speed of sound c (c≅343 m/s at 20° celsius temperature) and $\lfloor x+0.5 \rfloor$ indicates rounding to next integer. The loudspeaker gains $g_l$ are determined by $$g_l = \frac{r2_l}{r2_{max}} \tag{2}$$

The task of the Delay and Gain Compensation building block 32 is to attenuate and delay speakers that are closer to the listener than other speakers, so that these closer speakers do not dominate the sound direction perceived. The speakers are thus arranged on a virtual sphere, as shown in FIG. 1. The Mix & Filter block 31 now can use virtual speaker positions $\hat{R}_2=[\widehat{r2}_1, \widehat{r2}_2, \ldots, \widehat{r2}_{L_2}]$ with $\widehat{r2}_l=[r2_{max}, \hat{\Omega}_l^T]^T$ with a constant speaker distance.

Mix & Filter

In an initialization phase, the speaker positions of the input and idealized output configurations $R_1$, $\hat{R}_2$ are used to derive a $L_2 \times L_1$ mixing matrix G. During the process of rendering, this mixing matrix is applied to the input signals to derive the speaker output signals. As shown in FIGS. 4A and 4B, two general approaches exist. In the first approach shown in FIG. 4A, the mixing matrix is independent from the audio frequency and the output is derived by:

$$W_2=GW_1, \tag{3}$$

where $W_1 \in \mathcal{R}^{L_1 \times \tau}$, $W_2 \Sigma \mathcal{R}^{L_2 \times \tau}$ denote the input and output signals of $L_1$, $L_2$ audio channels and τ time samples in matrix notation. The most prominent method is Vector Base Amplitude Panning (VBAP) [1].

In the second approach, the mixing matrix becomes frequency dependent (G(f)), as shown in FIG. 4B. Then, a filter bank of sufficient resolution is needed, and a mixing matrix is applied to every frequency band sample according to eq. (3).

Examples for the latter approach are known [2], [3], [4]. For deriving the mixing matrix, the following approach is used: A virtual microphone array 51 as depicted in FIG. 5, is placed around the sweet spot. The microphone signals $M_1$ of sound received from the input configuration (the original directions, left-hand side) is compared to the microphone signals $M_2$ of sound received from the desired speaker configuration (right-hand side).

Let $\mathcal{M}_1 \in \mathcal{R}^{M \times \tau}$ denote M microphone signals receiving the sound radiated from the input configuration, and $\mathcal{M}_2 \in \mathcal{R}^{M \times \tau}$ be M microphone signals of the sound from the output configuration. They can be derived by $$\mathcal{M}_1=H_{M,L_1}W_1 \tag{4}$$

and $$\mathcal{M}_2=H_{M,L_2}W_2 \tag{5}$$

with $H_{M,L_1} \in \mathbb{C}^{M \times L_1}$, $H_{M,L_2} \in \mathbb{C}^{M \times L_2}$ being the complex transfer function of the ideal sound radiation in the free field, assuming spherical wave or plane wave radiation. The transfer functions are frequency dependent. Selecting a mid-frequency $f_m$ related to a filter bank, eq. (4) and eq. (5)

can be equated using eq. (3). For every $f_m$ the following equation needs to be solved to derive $G(f_m)$:

$$H_{M,L_1}W_1=H_{M,L_2}GW_1 \quad (6)$$

A solution that is independent of the input signals and that uses the pseudo inverse matrix of $H_{M,L_2}$ can be derived as:

$$G=H_{M,L_2}^{+}H_{M,L_1}. \quad (7)$$

Usually this produces non-satisfying results, and [2] and [5] present more sophisticated approached to solve eq. (6) for G.

Further, there is a completely different way of signal adaptive rendering, where the directional signals of the incoming audio content is extracted and rendered like audio objects. The residual signal is panned and de-correlated to the output speakers. This kind of audio rendering is much more expensive in terms of computational complexity, and often not free from artifacts. Signal adaptive rendering is not used and only mentioned here for completeness.

One problem is that a consumer's home setup is very likely to use a different placement of speakers due to real world constraints of a living room. Also the number of speakers may be different. The task of a renderer is thus to adapt the channel based audio signals to a new setup such that the perceived sound, loudness, timbre and spatial impression comes as close as possible to the original channel based audio as replayed on its original speaker setup, like e.g. in the mixing room.

SUMMARY OF THE INVENTION

The present invention provides a preferably computer-implemented method of rendering multi-channel audio signals that assures replay (i.e. reproduction) of the spatial signal components with correct loudness of the signal (ie. equal to the original setup). Thus, a directional signal that is perceived in the original mix coming from a direction is also perceived equally loud when rendered to the new loudspeaker setup. In addition, filters are provided that equalize the input signals to reproduce a timbre as close as possible as it would be perceived when listening to the original setup.

In one aspect, the invention relates to a method for rendering L1 channel-based input audio signals to L2 loudspeaker channels, where L1 is different from L2, as disclosed in claim 1. In one embodiment, a step of mixing the delay and gain compensated input audio signal for L2 audio channels uses a mixing matrix that is generated as disclosed in claim 5. A corresponding apparatus according to the invention is disclosed in claim 8 and claim 12, respectively.

In one aspect, the invention relates to a method for generating an energy preserving mixing matrix G for mixing input channel-based audio signals for L1 audio channels to L2 loudspeaker channels, as disclosed in claim 7. A corresponding apparatus for generating an energy preserving mixing matrix G according to the invention is disclosed in claim 14.

In one aspect, the invention relates to a computer readable medium having stored thereon executable instructions to cause a computer to perform a method according to claim 1, or a method according to claim 7.

In one embodiment of the invention, a computer-implemented method for generating an energy preserving mixing matrix G for mixing input channel-based audio signals for L1 audio channels to L2 loudspeaker channels comprises computer-executed steps of obtaining a first mixing matrix $\hat{G}$ from virtual source directions $\widehat{R_1}$ and target speaker directions $\widehat{r2}$, performing a singular value decomposition on the first mixing matrix $\hat{G}$ to obtain a singularity matrix S, processing the singularity matrix S to obtain a processed singularity matrix $\hat{S}$ with $\mathcal{S}_m$ non-zero diagonal elements, determining from the number of non-zero diagonal elements a scaling factor a according to $$a=\sqrt{\frac{L_1}{\mathcal{S}_m}}\ (\text{for } L2 \le L1) \text{ or } a=\sqrt{\frac{L_2}{\mathcal{S}_m}}\ (\text{for } L2 > L1),$$

and calculating a mixing matrix G by using the scaling factor according to $G=a\hat{U}\hat{S}V^T$. As a result, the perceived sound, loudness, timbre and spatial impression of multi-channel audio replayed on an arbitrary loudspeaker setup is improved, and in particular comes as close as possible to the original channel based audio as if replayed on its original speaker setup.

Further objects, features and advantages of the invention will become apparent from a consideration of the following description and the appended claims when taken in connection with the accompanying drawings.

BRIEF DESCRIPTION OF THE DRAWINGS

Exemplary embodiments of the invention are described with reference to the accompanying drawings, which show in FIG. 1 illustrates two exemplary loudspeaker setups;

FIG. 7A illustrates an exemplary rendering architecture according to one embodiment of the invention;

FIG. 7B illustrates an exemplary Mix & Filter block architecture according to one embodiment of the invention;

FIG. 8 illustrates an exemplary structure of one embodiment of a filter in the Mix&Filter block;

FIGS. 9A, 9B, 9C, 9D and 9E illustrate exemplary frequency responses for a remix of five channels; and FIG. 10A illustrates exemplary frequency responses for a remix of twenty-two channels.

FIG. 10B illustrates exemplary three filters of the first row of FIG. 10A FIG. 10C illustrates an exemplary resulting 5×22 mixing matrix G.

DETAILED DESCRIPTION OF THE INVENTION

Figure 1:
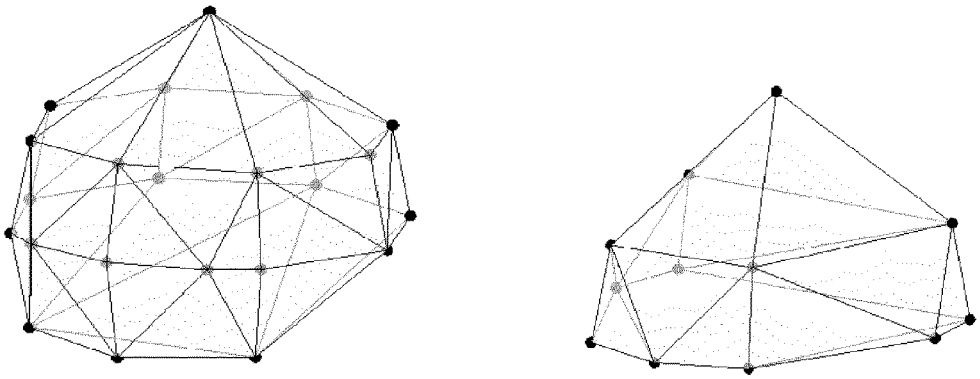
Figure 2:
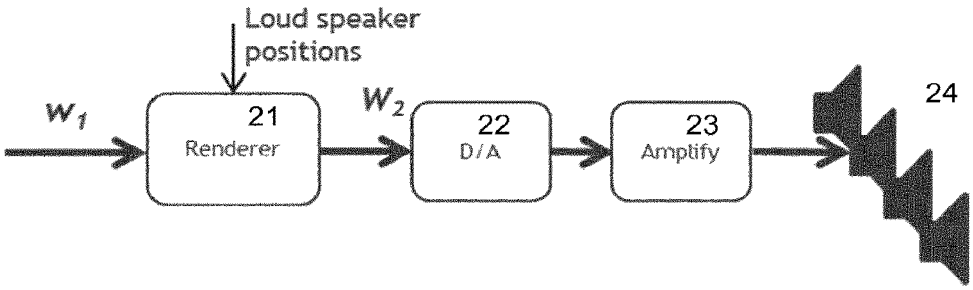
FIG. 2 illustrates a general structure for rendering content for a new loudspeaker setup.
Figure 3:
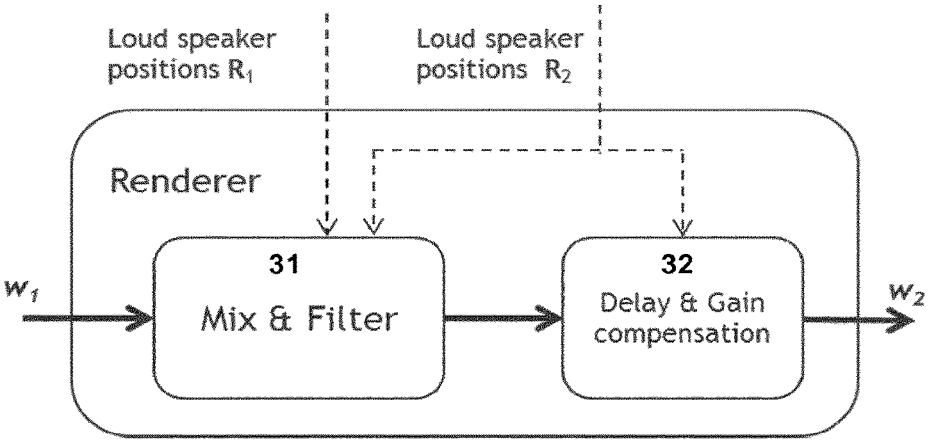
FIG. 3 illustrates a general structure for channel based audio rendering.
Figure 4A:
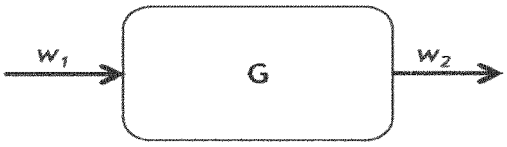
FIG. 4A illustrates a first method for mixing $L_1$ channels to $L_2$ output channels, using a frequency-independent mixing matrix G.
Figure 4B:
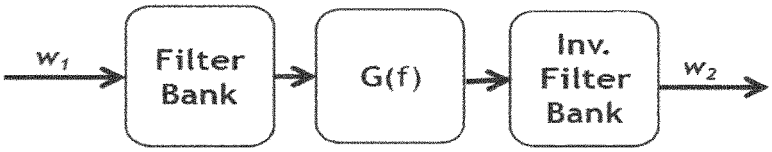
FIG. 4B illustrates a second method for missing $L_1$ channels to $L_2$ output channels, using a frequency dependent mixing matrix G(f)
Figure 5:
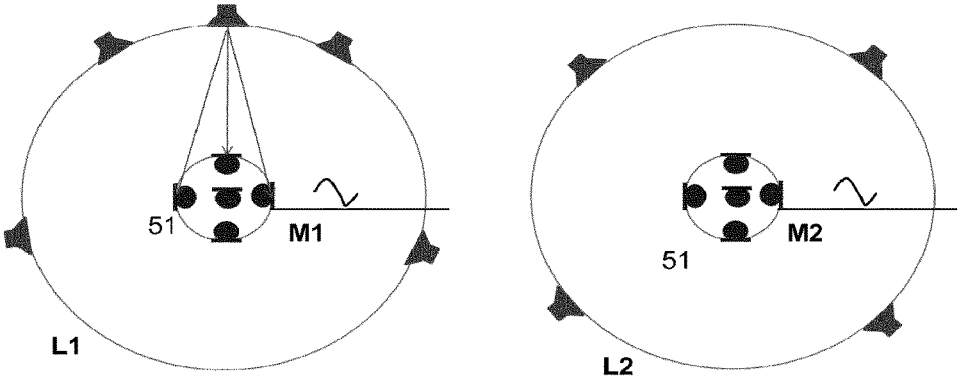
FIG. 5 illustrates a virtual microphone array used to compare the sound radiated from the original setup (input configuration) to a desired output configuration.
Figure 6A:
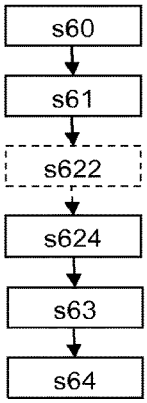
FIG. 6A illustrates a flow-chart of a method for rendering L1 channel-based input audio signals to L2 loudspeaker channels according to the invention.

FIG. 6A shows a flow-chart of a method for rendering a first number L1 of channel-based input audio signals to a different second number L2 of loudspeaker channels according to one embodiment of the invention. The method for rendering L1 channel-based input audio signals $w1_1$ to L2 loudspeaker channels, where the number L1 of channel-based input audio signals is different from the number L2 of loudspeaker channels, comprises steps of determining s60 a mix type of the L1 input audio signals, performing a first delay and gain compensation s61 on the L1 input audio signals according to the determined mix type, wherein a delay and gain compensated input audio signal with the first number L1 of channels and with a defined mix type is obtained, mixing s624 the delay and gain compensated input audio signal for the second number L2 of audio channels, wherein a remixed audio signal for the second number L2 of audio channels is obtained, clipping s63 the remixed audio signal, wherein a clipped remixed audio signal for the second number L2 of audio channels is obtained, and performing a second delay and gain compensation s64 on the clipped remixed audio signal for the second number L2 of audio channels, wherein the second number L2 of loudspeaker channels $w2_2$ are obtained.

Possible mix types include at least one of spherical, cylindrical and rectangular (or, more general, cubic). In one embodiment, the method comprises a further step of filtering s622 the delay and gain compensated input audio signal q71 having the first number L1 of channels in an equalization filter (or equalizer filter), wherein a filtered delay and gain compensated input audio signal is obtained. While the equalization filtering is in principle independent from the usage of, and can be used without, an energy preserving mixing matrix, it is particularly advantageous to use both in combination.

Figure 6B:
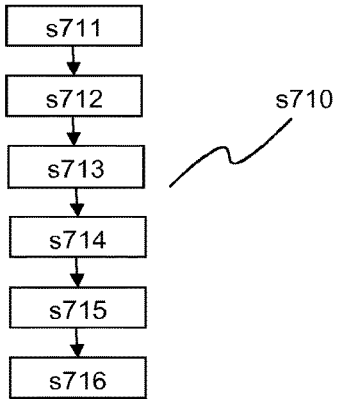
FIG. 6B illustrates a flow-chart of a method for generating an energy preserving mixing matrix G according to the invention.

FIG. 6B shows a flow-chart of a method for generating an energy preserving mixing matrix G according to one embodiment of the invention. The method s710 for obtaining an energy preserving mixing matrix G for mixing input channel-based audio signals for a first number L1 of audio channels to a second number L2 of loudspeaker channels comprises steps of obtaining s711 a first mixing matrix $\hat{G}$ from virtual source positions/directions $\widehat{R_1}$ and target speaker positions/directions $\widehat{r2}$ wherein a panning method is used, performing s712 a singular value decomposition on the first mixing matrix $\hat{G}$ according to $\hat{G}=USV^T$, wherein $U \in \mathcal{R}^{L_2 \times L_2}$ and $V \in \mathcal{R}^{L_1 \times L_1}$ are orthogonal matrices and $S \in \mathcal{R}^{L_1 \times L_2}$ is a singularity matrix and has s first diagonal elements being the singular values of G in descending order and all other elements of S are zero, processing s713 the singularity matrix S, wherein a quantized singularity matrix $\hat{S}$ is obtained with diagonal elements that are above a threshold set to one and diagonal elements that are below a threshold set to zero, determining s714 a number $\mathcal{S}_m$ of diagonal elements that are set to one in the quantized singularity matrix $\hat{S}$, determining s715 a scaling factor a according to $$a = \sqrt{\frac{L_1}{\mathcal{S}_m}} \text{ for } (L2 \le L1) \text{ or } a = \sqrt{\frac{L_2}{\mathcal{S}_m}} \text{ for } (L2 > L1),$$

and calculating s716 a mixing matrix G according to $G=a\hat{U}\hat{S}V^T$. The steps of any of the above-mentioned methods can be performed by one or more processing elements, such as microprocessors, threads of a GPU etc.

FIG. 7 shows a rendering architecture 70 according to one embodiment of the invention.

In the rendering architecture according to the embodiment shown in FIG. 7A, an additional "Gain and Delay Compensation" block 71 is used for preprocessing different input setups, such as spherical, cylindrical or rectangular input setups. Further, a modified "Mix & Filter" block 72 that is capable of preserving the original loudness is used. In one embodiment, the "Mix & Filter" block 72 comprises an equalization filter 722. The "Mix & Filter" block 72 is described in more detail with respect to FIG. 7B and FIG. 8. A clipping prevention block 73 prevents signal overflow, which may occur due to the modified mixing matrix. A determining unit 75 determines a mix type of the input audio signals.

FIG. 7B shows the Mix&Filter block 72 incorporating an equalization filter 722 and a mixer unit 724. FIG. 8 shows the structure of the equalization filter 722 in the Mix&Filter block. The equalization filter is in principle a filter bank with $L_1$ filters $EF_1, \ldots, EF_{L1}$, one for each input channel. The design and characteristics of the filters are described below. All blocks mentioned may be implemented by one or more processors or processing elements that may be controlled by software instructions.

The renderer according to the invention solves at least one of the following problems:

First, new 3D audio channel based content can be mixed for at least one of spherical, rectangular or cylindrical speaker setups. The setup information needs to be transmitted alongside e.g. with an index for a table entry signaling the input configuration (which assumes a constant speaker radius) to be able to calculate the real input speaker positions. In an alternative embodiment, full input speaker position coordinates can be transmitted along with the content as metadata. To use mixing matrices independent of the mixing type, a gain and delay compensation is provided for the input configuration.

Second, the invention provides an energy preserving mixing matrix G. Conventionally, the mixing matrix is not energy preserving. Energy preservation assures that the content has the same loudness after rendering, compared to the content loudness in the mixing room when using the same calibration of a replay system [6], [7], [8]. This also assures that e.g. 22-channel input or 10-channel input with equal 'Loudness, K-weighted, relative to Full Scale' (LKFS) content loudness appears equally loud after rendering.

One advantage of the invention is that it allows generating energy (and loudness) preserving, frequency independent mixing matrices. It is noted that the same principle can also be used for frequency dependent mixing matrices, which however are not so desirable. A frequency independent mixing matrix is beneficial in terms of computational complexity, but often a drawback can be a in change in timbre after remix. In one embodiment, simple filters are applied to each input loudspeaker channel before mixing, in order to avoid this timbre mismatching after mixing. This is the equalization filter 722. A method for designing such filters is disclosed below.

Energy preserving rendering has a drawback that signal overload is possible for peak audio signal components. In one embodiment of the present invention, an additional clipping prevention block 73 prevents such overload. In a simple realization, this can be a saturation, while in more sophisticated realizations this block is a dynamics processor for peak audio.

In the following, details about the mix type determining unit 75 and the Input Gain and Delay compensation 71 are described. If the input configuration is signaled by a table entry plus mix room information, like e.g. rectangular, cylindrical or spherical, the configuration coordinates are read from special prepared tables (e.g. RAM) as spherical coordinates. If the coordinates are transmitted directly, they are converted to spherical coordinates. A determining unit 75 determines a mix type of the input audio signals. Let $R_1=[r1_1, r1_2, \ldots, r1_{L1}]$ with $r1_1=[r1_l, \theta 1_l, \phi 1_l]^T=[r1_l, \Omega_l^T]^T$ being the positions of this input configuration.

In a first step the maximum radius is detected: $r1_{max}=\max([r1_1, \ldots r1_{L_2}]$. Because only relative differences are of interest for this building block, the radii are $r1_1$ scaled by $r2_{max}$ that is available from the gain and delay compensation initialization of the output configuration:

$$\widehat{r1}_l = r1_l \frac{r2_{max}}{r1_{max}} \tag{8}$$

The number of delay tabs $\check{d}_l$ and the gain values $\check{g}_l$ for every speaker are calculated as follows with $\widehat{R}_{1\,max}=r2_{max}$:

$$\check{d}_l=\lfloor(r2_{max}-\widehat{R}_{1\,l})f_s/c+0.5\rfloor \tag{9}$$

with sampling rate $f_s$, speed of sound c ($c\cong 343$ m/s at 20° celsius temperature) and $\lfloor x+0.5\rfloor$ indicates rounding to next integer.

The loudspeaker gains $\check{g}_l$ are determined by $$\check{g}_l = \frac{\widehat{r1}_l}{\widehat{r1}_{max}} \tag{10}$$

The Mix & Filter block now can use virtual speaker positions $\hat{R}_1=[\widehat{R}_{1\,1}, \widehat{R}_{1\,2}, \ldots, \widehat{R}_{1\,L_1}]$ with $\widehat{R}_{1\,l}=[\widehat{R}_{1\,max}, \Omega_l^T]^T$ with a constant speaker distance.

In the following, the Mixing Matrix design is explained.

First, the energy of the speaker signals and perceived loudness are discussed.

FIG. 7A shows a block diagram defining the descriptive variables. $L_1$ loudspeakers signals have to be processed to $L_2$ signals (usually, $L_2 \leq L_1$). Replay of the loudspeaker feed signals $W_2$ (shown as $W_{2_2}$ in FIG. 7) should ideally be perceived with the same loudness as if listening to a replay in the mixing room, with the optimal speaker setup. Let $W_1$ be a matrix of $L_1$ loudspeaker channels (rows) and r samples (columns).

The energy of the signal $W_1$, of the τ-time sample block is defined as follows:

$$E_{w_1}=\|W_1\|_{fro}^2=\Sigma_{i=1}^{\tau}\Sigma_{l=1}^{L1}W_{1_{l,i}}^2=\Sigma_{i=1}^{\tau}w_{1_t}^T w_{1_t} \tag{11}$$

Here $W_{l,i}$ are the matrix elements of $W_1$, l denotes the speaker index, i denotes the sample index, $\|\ \|_{fro}$ denotes the Frobenius matrix norm, $w_{1_t}$ is the $t^{th}$ column vector of $W_1$ and $[\ ]^T$ denotes vector or matrix transposition.

This energy $E_w$ gives a fair estimate of the loudness measure of a channel based audio as defined in [6], [7], [8], where the K-filter suppresses frequencies lower than 200 Hz.

Mixing of the signals $W_1$ provides signals $W_2$. The signal energy after mixing becomes:

$$E_{w_2}=\|W_2\|_{fro}=\Sigma_{i=1}^{\tau}\Sigma_{l=1}^{L2}W_{2_{l,j}}^2 \tag{12}$$

where $L_2$ is the new number of loudspeakers, with $L_2 \leq L_1$.

The process of rendering is assumed to be performed by a mixing matrix G, signals $W_2$ are derived from $W_1$ as follows:

$$W_2=GW_1 \tag{13}$$

Evaluating $E_{w_2}$ and using the columns vector decomposition of $W_1=[w_{1_1}, \ldots, w_{1_t}, \ldots, w_{1_\tau}]$ with $w_{1_t}=[w_{1_{t,1}}, \ldots, w_{1_{t,l}}, \ldots, w_{1_{t,L}}]^T$ then leads to:

$$E_{w_2}=\Sigma_{i=1}^{\tau}\Sigma_{l=1}^{L}W_{2_{l,i}}^2=\Sigma_{i=1}^{\tau}=[Gw_{1_t}]^T M w_{1_t}=\Sigma_{i=1}^{\tau}w_{1_t}^T G^T G w_{1_t} \tag{14}$$

In one embodiment, loudness preservation is then obtained as follows.

The loudness of the original signal mix is preserved in the new rendered signal if:

$$E_1=E_2 \tag{15}$$

From eq. (14) it becomes apparent that mixing matrix M needs to be orthogonal and $$G^T G=I \tag{16}$$

with I being the $L_1 \times L_1$ unit matrix.

An optimal rendering matrix (also called mixing matrix or decode matrix) can be obtained as follows, according to one embodiment of the invention.

Step 1: A conventional mixing matrix $\hat{G}$ is derived by using panning methods. A single loudspeaker $l_1$ from the set of original loudspeakers is viewed as a sound source to be reproduced by $L_2$ speakers of the new speaker setup. Preferred panning methods are VBAP [1] or robust panning [2] for a constant frequency (i.e. a known technology can be used for this step). To determine the mixing matrix $\hat{G}$, the modified speaker positions $\hat{R}_2$, $\hat{R}_1$ are used, $\hat{R}_2$ for the output configuration and $\hat{R}_1$ for the virtual source directions.

Step 2: Using compact singular value decomposition, the mixing matrix is expressed as a product of three matrices:

$$\hat{G}=USV^T \tag{17}$$

$U \in \mathcal{R}^{L_2 \times L_2}$ and $V \in \mathcal{R}^{L_1 \times L_1}$ are orthogonal matrices and $S \in \mathcal{R}^{L_1 \times L_2}$ has s first diagonal elements (the singular values in descending order), with $s \leq L_2$. The other matrix elements are zeros.

Note that this holds for the case of $L_2 \leq L_1$, (remix $L_2=L_1$, downmix $L_2<L_1$). For the case of upmix ($L_2>L_1$), $L_2$ needs to be replaced by $L_1$ in this section.

Step 3: A new matrix $\hat{S}$ is formed from S where the diagonal elements are replaced by a value of one, but very low valued singular values $S_{\mathcal{S}} << s_{max}$ are replaced by zeros. A threshold in the range of −10 dB . . . −30 dB or less is usually selected (e.g. −20 dB is a typical value). The threshold becomes apparent from actual numbers in realistic examples, since there will occur two groups of diagonal elements: elements with larger value and elements with considerably smaller value.

The threshold is for distinguishing among these two groups.

For most speaker settings, the number of non-zero diagonal elements $\mathcal{S}_m$ is $\mathcal{S}_m=L_2$, but for some settings it becomes lower and then $\mathcal{S}_m<L_2$. This means that $L_2-\mathcal{S}_m$ speakers will not be used to replay content; there is simply no audio information for them, and they remain silent.

Let $\mathcal{S}_m$ denote the last singular value to be replaced by one. Then the mixing matrix G is determined by:

$$G=aU\hat{S}V^T \tag{18}$$

with the scaling factor $$a=\sqrt{\frac{L_1}{\mathcal{S}_m}} \text{ for } (L2 \leq L1) \tag{19}$$

or, respectively, $$a = \sqrt{\frac{L_2}{\mathcal{S}_m}} \text{ for } (L2 > L1) \tag{19'}$$

The scaling factor is derived from: $G^TG=a^2V\hat{S}^2V^T=a^2VV^T$, where $VV^T$ has $\mathcal{S}_m$ Eigenvalues equal to one. That means that $|VV^T|_{fro}=\sqrt{\mathcal{S}_m}$. Thus, simply down mixing the $L_1$ signals to $\mathcal{S}_m$ signals will reduce the energy, unless $\mathcal{S}_m=L_1$ (in other words: when the number of output speakers matches the number of input speakers). With $|I_{L_1}|_{fro}=\sqrt{L_1}$, a scaling factor $$\sqrt{\frac{L_1}{\mathcal{S}_m}}$$

compensates the loss of energy during down-mixing.

As an example, processing of a singularity matrix is described in the following. E.g., an initial (conventional) mixing matrix for L loudspeakers is decomposed using compact singular value decomposition according to eq. (17): $\hat{G}=USV^T$. The singularity matrix S is square (with L×L elements, $L=\min\{L_1,L_2\}$ for compact singular value decomposition) and is a diagonal matrix of the form $$S = \begin{bmatrix} s_1 & \dots & 0 \\ 0 & s_2 & \vdots \\ \vdots & \ddots & 0 \\ 0 & \dots & s_L \end{bmatrix}$$

with $s_1 \geq s_2 \geq \dots \geq s_L$ (i.e., $s_1=s_{max}$). Then the singularity matrix is processed by setting the coefficients $s_1, s_2, \dots, s_L$ to be either 1 or 0, depending whether each coefficient is above a threshold of e.g. $0.06*s_{max}$. This is similar to a relative quantization of the coefficients. The threshold factor is exemplary 0.06, but can be (when expressed in decibel) e.g. in the range of −10 dB or lower.

For a case with e.g. L=5 and e.g. only $s_1$ and $s_2$ being above the threshold and $s_3$, $s_4$ and $s_5$ being below the threshold, the resulting processed (or "quantized") singularity matrix $\hat{S}$ is $$\hat{S} = \begin{bmatrix} 1 & 0 & 0 & 0 & 0 \\ 0 & 1 & 0 & 0 & 0 \\ 0 & 0 & 0 & 0 & 0 \\ 0 & 0 & 0 & 0 & 0 \\ 0 & 0 & 0 & 0 & 0 \end{bmatrix}.$$

Thus, the number of its non-zero diagonal coefficients $\mathcal{S}_m$ is two.

In the following, the Equalization Filter 722 is described.

When mixing between different 3D setups, and especially when mixing from 3D setups to 2D setups, timbre may change. E.g. for 3D to 2D, a sound originally coming from above is now reproduced using only speakers on the horizontal plane. The task of the equalization filter is to minimize this timbre mismatch and maximize energy preservation. Individual filters $F_l$ are applied to each channel of the $L_1$ channels of the input configuration before applying the mixing matrix, as shown in FIG. 7*b*). The following shows the theoretical deviation and describes how the frequency response of the filters is derived.

A model according to FIG. 7 and eqs. (4) and (5) is used. Both equations are reprinted here for convenience:

$$\mathcal{M}_1 = H_{M,L_1} W_1 \tag{20}$$

and $$\mathcal{M}_2 = H_{M,L_2} W_2 \tag{21}$$

with $H_{M,L_1} \in \mathbb{C}^{M \times L_1}$, $H_{M,L_2} \in \mathbb{C}^{M \times L_2}$ being the complex transfer function of the ideal sound radiation in the free field assuming spherical wave or plane wave radiation. These matrices are functions of frequency, and they can be calculated using the position information $\hat{R}_2$, $\hat{R}_1$. We define $W_2=\tilde{G}W_1$, where $\tilde{G}$ is a function of frequency.

Instead of equating eqs. (4) and (5), as mentioned in the background section, we will equate the energies. And since we want to equalize for the sound of the speaker directions of the input configuration, we can solve the considerations for each input speaker at a time (loop over $L_1$).

The energy measured at the virtual microphones for the input setup, if only one speaker l is active, is given by $$|\mathcal{M}_{1,l}|_{fro}^2 = |h_{M,l} w_{1l}|_{fro}^2 \tag{22}$$

with $h_{M,1}$ representing the lth column of $H_{M,L_1}$ and $w_{1l}$ one row of $W_1$, i.e. the time signal of speaker l with τ samples. Rewriting the Frobenius norm analog to eq. (11), we can further evaluate eq. (22) to:

$$|\mathcal{M}_{1,l}|_{fro}^2 = \Sigma_{i=1}^{\tau} w_{1l}^T w_{1l} h_{M,l}^H h_{M,l} = E_{wl} h_{M,l}^H h_{M,l} \tag{23}$$

where $(\ )^H$ is conjugate complex transposed (Hermitian transposed) and $E_{wl}$ is the energy of speaker signal l. The vector $h_{M,l}$ is composed out of complex exponentials (see eqs. (31), (32)) and the multiplication of an element with its conjugate complex equals one, thus $h_{M,l}^H h_{M,l}=L_1$:

$$|\mathcal{M}_{1,l}|_{fro}^2 = E_{wl} L_1 \tag{24}$$

The measures at the virtual microphones after mixing are given by $\mathcal{M}_2=H_{M,L_2}\tilde{G}W_1$.

If only one speaker is active, we can rewrite to:

$$\mathcal{M}_{2,l} = H_{M,L_2} \tilde{g}_l w_{1l} \tag{25}$$

with $\tilde{g}_l$ being the lth column of $\tilde{G}$. We define $\tilde{G}$ to be decomposable into a frequency dependent part related to speaker l and mixing matrix G derived from eq. (24):

$$\tilde{G}(f) = \mathrm{diag}(b(f))G \tag{26}$$

with b as a frequency dependent vector of $L_1$ complex elements and (f) denoting frequency dependency, which is neglected in the following for simplicity. With this, eq. (25) becomes:

$$\mathcal{M}_{2,l} = H_{M,L_2} b_l g\, w_{1l} \tag{27}$$

where g is the $l^{th}$ column of G and $b_l$ the lth element of b. Using the same considerations of the Frobenius norm as above, the energy at the virtual microphones becomes:

$$|\mathcal{M}_{2,l}|_{fro}^2 = E_{wl} (H_{M,L_2} b_l g)^H (H_{M,L_2} b_l g) \tag{28}$$

which can be evaluated to:

$$|\mathcal{M}_{2,l}|_{fro}^2 = E_{wl} b_l^2 g^T H_{M,L_2}^H H_{M,L_2} g \tag{29}$$

We can now equate the energies according to eq. (24) and eq. (29) respectively, and solve for $b_l$ for each frequency f:

$$b_l = \sqrt{\frac{L_1}{g^T H_{M,L_2}^H H_{M,L_2} g}} \tag{30}$$

The $b_l$ of eq. (30) are frequency-dependent gain factors or scaling factors, and can be used as coefficients of the equalization filter 722 for each frequency band, since $b_l$ and $H_{M,L_2}^H H_{M,L_2}$ are frequency-dependent.

In the following, practical filter design for the equalization filter 722 is described.

Virtual microphone array radius and transfer function are taken into account as follows.

To match the perceptual timbre effects of humans best, a microphone radius $r_M$ of 0.09 m is selected (the mean diameter of a human head is commonly assumed to be about 0.18 m). M>>L1 virtual microphones are placed on a sphere or radius $r_M$ around the origin (sweet spot, listening position). Suitable positions are known [11]. One additional virtual microphone is added at the origin of the coordinate system.

The transfer matrices $H_{M,L_2} \in \mathbb{C}^{M \times L_2}$ are designed using a plane wave or spherical wave model. For the latter, the amplitude attenuation effects can be neglected due to the gain and delay compensation stages. Let $h_{m,l}$ be an abstract matrix element of the transfer matrices $H_{M,L}$, for the free field transfer function from speaker l to microphone m (which also indicate column and row indices of the matrices). The plane wave transfer function is given by $$h_{m,l} = e^{ikr_m \cos(\gamma_{l,m})} \tag{31}$$

with i the imaginary unit, $r_m$ the radius of the microphone position (ether $r_M$ or zero for the origin position) and $\cos(\gamma_{l,m}) = \cos\theta_1 \cos\theta_m + \sin\theta_1 \sin\theta_m \cos(\phi_l - \phi_m)$ the cosine of the spherical angles of the positions of speaker l and microphone m. The frequency dependency is given by $$k = \frac{2\pi f}{c},$$

With j the frequency and c the speed of sound. The spherical wave transfer function is given by:

$$h_{m,l} = e^{-ikr_{l,m}} \tag{32}$$

with $r_{l,m}$ the distance speaker l to microphone m.

The frequency response $B_{resp} \in \mathbb{C}^{L_1 \times F_N}$ of the filter is calculated using a loop over $F_N$ discrete frequencies and a loop over all input configuration speakers $L_1$:

Calculate G according to the above description (3-step procedure for design of optimal rendering matrices):

```
for (f=0; f=f+fstep; f<F_N fstep)        /* loop over frequencies */
  k=2*pi*f/342;
  (... calculate H_{M,L2}(f) according to eq.(31) or eq.(32) )
  Ȟ = H_{M,L2}^H H_{M,L2}
  for (l=1; l++; l<=L_1)                 /* loop over input channels */
    g= G(:,l)

    B_resp(l,f) = sqrt( L_1 / (g^T Ȟ g) )

  end
end
```

The filter responses can be derived from the frequency responses $B_{resp}$ (l,f) using standard technologies. Typically, it is possible to derive a FIR filter design of order equal or less than 64, or IIR filter designs using cascaded bi-quads with even less computational complexity. FIGS. 9A, 9B, 9C, 9D and 9E and 10 show design examples.

In FIGS. 9A, 9B, 9C, 9D and 9E, example frequency responses of filters for a remix of 5-channels ITU setup [9] (L,R,C,Ls,Rs) to +/−30° 2-channel stereo, and an exemplary resulting 2×5 mixing matrix G are shown. The mixing matrix was derived as described above, using [2] for 500 Hz. A plane wave model was used for the transfer functions. As shown, two of the filters (upper row, for two of the channels) have in principle low-pass (LP) characteristics, and three of the filters (lower rows, for the remaining three channels) have in principle high-pass (HP) characteristics. It is intended that the filters do not have ideal HP or LP characteristics, because together they form an equalization filter (or equalization filter bank). Generally, not all the filters have substantially same characteristics, so that at least one LP and at least one HP filter is employed for the different channels.

In FIG. 10A, example responses of filters for a remix of 22 channels of the 22.2 NHK setup [10] to ITU 5-channel surround [9] are shown. In FIG. 10B, the three filters of the first row of FIG. 10A are exemplarily shown. In FIG. 10C, a resulting 5×22 mixing matrix G is shown, as obtained by the present invention.

The present invention can be used to adjust audio channel based content with arbitrary defined $L_1$ loudspeaker positions to enable replay to $L_2$ real-world loudspeaker positions. In one aspect, the invention relates to a method of rendering channel based audio of $L_1$ channels to $L_2$ channels, wherein a loudness & energy preserving mixing matrix is used.

The matrix is derived by singular value decomposition, as described above in the section about design of optimal rendering matrices. In one embodiment, the singular value decomposition is applied to a conventionally derived mixing matrix.

In one embodiment, the matrix is scaled according to eq. (19) or (19') by a factor of $$\sqrt{\frac{L_1}{\mathcal{S}_m}} \text{ (for } L_1 \geq L_2\text{)},$$

or by a factor of $$\sqrt{\frac{L_2}{\mathcal{S}_m}} \text{ (for } L_1 < L_2\text{)}.$$

Conventional matrices can be derived by using various panning methods, e.g. VBAP or robust panning. Further, conventional matrices use idealized input and output speaker positions (spherical projection, see above). Therefore, in one aspect, the invention relates to a method of filtering the $L_1$ input channels before applying the mixing matrix. In one embodiment, input signals that use different speaker positions are mapped to a spherical projection in a Delay & Gain Compensation block 71.

In one embodiment, equalization filters are derived from the frequency responses as described above.

In one embodiment, a device for rendering a first number $L_1$ of channels of channel-based audio signals (or content) to a second number $L_2$ of channels of channel-based audio signals (or content) is assembled out of at least the following building blocks/processing blocks:

input (and output) gain and delay compensation blocks 71,74, having the purpose to map the input and output speaker positions to a virtual sphere. Such spherical structure is required for the above-described mixing matrix to be applicable;

equalization filters 722 derived by the method described above for filtering the first number $L_1$ of channels after input gain and delay compensation;

a mixer unit 72 for mixing the first number $L_1$ of input channels to the second number $L_2$ of output channels by applying the energy preserving mixing matrix 724 as derived by the method described above. The equalization filters 722 may be part of the mixer unit 72, or may be a separate module;

a signal overflow detection and clipping prevention block (or clipping unit) 73 to prevent signal overload to the signals of $L_2$ channels; and an output gain and delay correction block 74 (already mentioned above).

In one embodiment, a method for obtaining or generating an energy preserving mixing matrix G for mixing L1 input audio channels to L2 output channels comprises steps of obtaining s711 a first mixing matrix $\hat{G}$, performing s712 a singular value decomposition on the first mixing matrix $\hat{G}$ to obtain a singularity matrix S, processing s713 the singularity matrix S to obtain a processed singularity matrix $\hat{S}$, determining s715 a scaling factor a, and calculating s716 an improved mixing matrix G according to $G=a\hat{U}\hat{S}V^T$. One advantage of the improved mixing mode matrix G is that the perceived sound, loudness, timbre and spatial impression of multi-channel audio replayed on an arbitrary loudspeaker setup practically equals that of the original speaker setup. Thus, it is not required any more to locate loudspeakers strictly according to a predefined setup for enjoying a maximum sound quality and optimal perception of directional sound signals.

In one embodiment, an apparatus for rendering L1 channel-based input audio signals to L2 loudspeaker channels, where L1 is different from L2, comprises at least one of each of a determining unit for determining a mix type of the L1 input audio signals, wherein possible mix types include at least one of spherical, cylindrical and rectangular;

a first delay and gain compensation unit for performing a first delay and gain compensation on the L1 input audio signals according to the determined mix type, wherein a delay and gain compensated input audio signal with L1 channels and with a defined mix type is obtained;

a mixer unit for mixing the delay and gain compensated input audio signal for L2 audio channels, wherein a remixed audio signal for L2 audio channels is obtained;

a clipping unit for clipping the remixed audio signal, wherein a clipped remixed audio signal for L2 audio channels is obtained; and a second delay and gain compensation unit for performing a second delay and gain compensation on the clipped remixed audio signal for L2 audio channels, wherein L2 loudspeaker channels are obtained.

Further, in one embodiment of the invention, an apparatus for obtaining an energy preserving mixing matrix G for mixing input channel-based audio signals for L1 audio channels to L2 loudspeaker channels comprises at least one processing element and memory for storing software instructions for implementing a first calculation module for obtaining a first mixing matrix $\hat{G}$ from virtual source directions $\widehat{R_1}$ and target speaker directions $\widehat{r2}$ wherein a panning method is used;

a singular value decomposition module for performing a singular value decomposition on the first mixing matrix $\hat{G}$ according to $\hat{G}=USV^T$, wherein $U\in\mathcal{R}^{L_2\times L_2}$ and $V\in\mathcal{R}^{L_1\times L_1}$ are orthogonal matrices and $S\in\mathcal{R}^{L_1\times L_2}$ is a singularity matrix and has s first diagonal elements being the singular values of G in descending order and all other elements of S are zero;

a processing module processing the singularity matrix S, wherein a quantized singularity matrix $\hat{S}$ is obtained with diagonal elements that are above a threshold set to one and diagonal elements that are below a threshold set to zero;

a counting module for determining a number $\mathcal{S}_m$ of diagonal elements that are set to one in the quantized singularity matrix $\hat{S}$;

a second calculation module for determining a scaling factor a according to $$a=\sqrt{\frac{L_1}{\mathcal{S}_m}}\ \text{for}\ (L2\le L1)\ \text{or}\ a=\sqrt{\frac{L_2}{\mathcal{S}_m}}\ \text{for}\ (L2>L1);$$

and a third calculation module for calculating a mixing matrix G according to $$G=aU\hat{S}V^T.$$

Advantageously, the invention is usable for content loudness level calibration. If the replay levels of a mixing facility and of presentation venues are setup in the manner as described, switching between items or programs is possible without further level adjustments. For channel based content, this is simply achieved if the content is tuned to a pleasant loudness level at the mixing site. The reference for such pleasant listening level can either be the loudness of the whole item itself or an anchor signal.

If the reference is the whole item itself, this is useful for 'short form content', if the content is stored as a file. Besides adjustment by listening, a measurement of the loudness in Loudness Units Full Scale (LUFS) according to EBU R128 [6] can be used to loudness adjust the content. Another name for LUFS is 'Loudness, K-weighted, relative to Full Scale' from ITU-R BS.1770 [7] (1 LUFS=1 LKFS). Unfortunately [6] only supports content for setups up to 5-channel surround. It has not been investigated yet if loudness measures of 22-channel files correlate with perceived loudness if all 22 channels are factored by equal channel weights of one.

If the above-mentioned reference is an anchor signal, such as in a dialog, the level is selected in relation to this signal. This is useful for 'long form content' such as film sound, live recordings and broadcasts. An additional requirement, extending the pleasant listening level, is intelligibility of the spoken word here. Again, besides an adjustment by listening, the content may be normalized related a loudness measure, such as defined in ATSC A/85 [8]. First parts of the content are identified as anchor parts. Then a measure as defined in [7] is computed or these signals and a gain factor to reach the target loudness is determined. The gain factor is used to scale the complete item. Unfortunately, again the maximum number of channels supported is restricted to five.

Out of artistic considerations, content should be adjusted by listening at the mixing studio. Loudness measures can be used as a support and to show that a specified loudness is not exceeded. The energy $E_w$ according to eq. (11) gives a fair estimate of the perceived loudness of such an anchor signal for frequencies over 200 Hz. Because the K-filter suppresses frequencies lower than 200 Hz [5], $E_w$ is approximately proportional to the loudness measure.

It is noted that when a "speaker" is mentioned herein, a loudspeaker is meant. Generally, a speaker or loudspeaker is a synonym for any sound emitting device. It is noted that usually where speaker directions are mentioned in the specification or the claims, also speaker positions can be equivalently used (and vice versa).

While there has been shown, described, and pointed out fundamental novel features of the present invention as applied to preferred embodiments thereof, it will be understood that various omissions and substitutions and changes in the apparatus and method described, in the form and details of the devices disclosed, and in their operation, may be made by those skilled in the art without departing from the spirit of the present invention. E.g., although in the above embodiments, the number L1 of channels of the channel-based input audio signals is usually different from the number L2 of loudspeaker channels, it is clear that the invention can also be applied in cases where both numbers are equal (so-called remix). This may be useful in several cases, e.g. if directional sound should be optimized for any irregular loudspeaker setup. Further, it is generally advantageous to use an energy preserving rendering matrix for rendering. It is expressly intended that all combinations of those elements that perform substantially the same function in substantially the same way to achieve the same results are within the scope of the invention.

Substitutions of elements from one described embodiment to another are also fully intended and contemplated. It will be understood that the present invention has been described purely by way of example, and modifications of detail can be made without departing from the scope of the invention.

Each feature disclosed in the description and (where appropriate) the claims and drawings may be provided independently or in any appropriate combination. Features may, where appropriate be implemented in hardware, software, or a combination of the two. Connections may, where applicable, be implemented as wireless connections or wired, not necessarily direct or dedicated, connections.

Reference numerals appearing in the claims are by way of illustration only and shall have no limiting effect on the scope of the claims.

CITED REFERENCES

[1] Pulkki, V., "Virtual Sound Source Positioning Using Vector Base Amplitude Panning", J. Audio Eng. Soc., vol. 45, pp. 456-466 (1997 June).

[2] Poletti, M., "Robust two-dimensional surround sound reproduction for non-uniform loudspeaker layouts". J. Audio Eng. Soc., 55(7/8):598-610, July/August 2007.

[3] O. Kirkeby and P. A. Nelson, "Reproduction of plane wave sound fields," J. Acoust. Soc. Am. 94 (5), 2992-3000 (1993).

[4] Fazi, F.; Yamada, T; Kamdar, S.; Nelson P. A.; Otto, P., "Surround Sound Panning Technique Based on a Virtual Microphone Array", AES Convention:128 (May 2010) Paper Number:8119

[5] Shin, M.; Fazi, F.; Seo, J.; Nelson, P. A. "Efficient 3-D Sound Field Reproduction", AES Convention:130 (May 2011) Paper Number:8404

[6] EBU Technical Recommendation R128, "Loudness Normalization and Permitted Maximum Level of Audio Signals", Geneva, 2010 [http://tech.ebu.ch/docs/r/r128.pdf]

[7] ITU-R Recommendation BS.1770-2, "Algorithms to measure audio programme loudness and true-peak audio level", Geneva, 2011.

[8] ATSC A/85, "Techniques for Establishing and Maintaining Audio Loudness for Digital Television", Advanced Television Systems Committee, Washington, D.C., Jul. 25, 2011.

[9] ITU-R BS 775-1 (1994)

[10] Hamasaki, K.; Nishiguchi, T.; Okumura, R.; Nakayama, Y.; Ando, A. "A 22.2 multichannel sound system for ultrahigh-definition TV (UHDTV)," SMPTE Motion Imaging J., pp. 40-49, April 2008.

[11] Jörg Fliege and Ulrike Maier. A two-stage approach for computing cubature formulae for the sphere. Technical report, Fachbereich Mathematik, Universität Dortmund, 1999. Node numbers & report can be found at http://www.personal.soton.ac.uk/jf1w07/nodes/nodes.html

The invention claimed is:

1. A method for loudspeaker rendering, the method comprising:

determining a mix type for channel-based input audio signals, wherein the mix type specifies a geometry for reproducing the input audio signals;

performing a first delay and gain compensation on the input audio signals based on the determined mix type to obtain a delay and gain compensated input audio signal with a defined mix type;

determining a remixed audio signal for output audio channels based on applying an energy preserving mixing matrix to the delay and gain compensated input audio signal for L2 audio channels, wherein the remixed audio signal for output audio channels is further based on a second delay and gain compensation;

wherein the energy preserving mixing matrix has matrix elements that are energy scaled based on a threshold and a scaling factor.

2. The method of claim 1, wherein the defined mix type is spherical.

3. The method of claim 1, wherein the input signal is optimized for L1 regular loudspeaker positions and the rendering is optimized for L2 arbitrary loudspeaker positions, wherein at least one of the L2 arbitrary loudspeaker positions is different from the L1 regular loudspeaker positions.

4. An apparatus for loudspeaker rendering, the apparatus comprising at least one processor comprising at least one of each of:

a determining unit for determining a mix type for channel-based input audio signals, wherein the mix type specifies a geometry for reproducing the input audio signals;

a first delay and compensation unit for performing a first delay and gain compensation on the input audio signals based on the determined mix type to obtain a delay and gain compensated input audio signal with a defined mix type;

a remixing unit for determining a remixed audio signal for output audio channels based on applying an energy preserving mixing matrix to the delay and gain compensated input audio signal for L2 audio channels, wherein the remixed audio signal for output audio channels is further based on a second delay and gain compensation, and, wherein the energy preserving mixing matrix has matrix elements that are energy scaled based on a threshold and a scaling factor.

5. The apparatus of claim 4, wherein the defined mix type is spherical.

6. The apparatus of claim 4, wherein the input signal is optimized for L1 regular loudspeaker positions and the rendering is optimized for L2 arbitrary loudspeaker positions, wherein at least one of the L2 arbitrary loudspeaker positions is different from the L1 regular loudspeaker positions.

7. A non-transitory computer readable storage medium having stored thereon instructions that when executed on a computer cause the computer to perform a method of claim 1.

* * * * *